US007905177B2

(12) United States Patent
Deguire et al.

(10) Patent No.: US 7,905,177 B2
(45) Date of Patent: Mar. 15, 2011

(54) SAFE AND ARM SYSTEM FOR A ROBOT

(75) Inventors: Daniel R. Deguire, Blackstone, MA (US); Peter Wells, Framingham, MA (US); Pierre Bergeron, Hooksett, NH (US); Joshua Huggins, Allenstown, NH (US); Mark St. Lawrence, Concord, NH (US)

(73) Assignee: Foster-Miller, Inc., Waltham, MA (US)

( * ) Notice: Subject to any disclaimer, the term of this patent is extended or adjusted under 35 U.S.C. 154(b) by 529 days.

(21) Appl. No.: 11/543,427

(22) Filed: Oct. 5, 2006

(65) Prior Publication Data

US 2008/0083344 A1 Apr. 10, 2008

Related U.S. Application Data

(60) Provisional application No. 60/736,612, filed on Nov. 14, 2005.

(51) Int. Cl.
*F42C 15/40* (2006.01)

(52) U.S. Cl. ..... 102/262

(58) Field of Classification Search ..... 86/50; 102/262
See application file for complete search history.

(56) References Cited

U.S. PATENT DOCUMENTS 3,575,085 A * 4/1971 McAdam, Jr. ..... 89/41.09
3,803,974 A * 4/1974 Everest et al. ..... 89/1.56
3,808,940 A * 5/1974 Schillreff et al. ..... 89/1.1
3,888,181 A * 6/1975 Kups ..... 102/221
4,063,485 A * 12/1977 Carter et al. ..... 89/1.816
4,089,268 A * 5/1978 Jaroska et al. ..... 102/221
4,205,589 A * 6/1980 Engler et al. ..... 89/41.07
4,234,850 A * 11/1980 Collins ..... 327/271
4,621,562 A 11/1986 Carr et al.
4,884,506 A * 12/1989 Guerreri ..... 102/200
4,932,831 A 6/1990 White et al.
5,022,812 A 6/1991 Coughlan et al.
5,767,437 A * 6/1998 Rogers ..... 102/217
6,113,343 A 9/2000 Goldenberg et al.
6,535,793 B2 3/2003 Allard
6,578,464 B2 6/2003 Ebersole, Jr. et al.
6,745,663 B2 6/2004 Ebersole, Jr. et al.

(Continued)

OTHER PUBLICATIONS

Northrop Grumman Remotec ANDROS F6A Heavy Duty Robot, http://www.es.northropgrumman.com/remotec/f6a.htm (1pg).

(Continued)

*Primary Examiner* — Michael Carone
*Assistant Examiner* — Jonathan C Weber
(74) *Attorney, Agent, or Firm* — Iandiorio Teska & Coleman

(57) ABSTRACT

A safe and arm system includes an operator control subsystem including a first arm switch, a second arm switch, and a fire switch. A fire control subsystem is responsive to the operator control subsystem and includes at least a pair of terminals for connection to a munition. The terminals are initially shorted together and without a ground. A power supply control circuit is configured to supply power to the terminals. A ground supply circuit is configured to ground one said terminal. A terminal shorting circuit is configured to remove the short across the pair of terminals. The power supply control circuit, the ground supply circuit, and the terminal shorting circuit are configured to ground one terminal, remove the short across the pair of terminals, and to supply power to the terminals only if the first and second arm switches and the fire switch are all activated in a predetermined sequence.

14 Claims, 6 Drawing Sheets

U.S. PATENT DOCUMENTS

| | | | | |
|---|---|---|---|---|
| 6,860,206 | B1 | 3/2005 | Rudakevych et al. | |
| 6,889,594 | B2 | 5/2005 | Ebersole, Jr. et al. | |
| 7,143,696 | B2 | 12/2006 | Rudakevych et al. | |
| 2002/0037508 | A1 | 3/2002 | Cargill et al. | |
| 2004/0216932 | A1 | 11/2004 | Giovanetti et al. | |
| 2008/0121097 | A1 * | 5/2008 | Rudakevych et al. | 89/28.05 |

OTHER PUBLICATIONS

Northrop Grumman Electronic Systems-Accessories for Remotec ANDROS F6A, http://www.es.northropgrumman.com/remotec/details/f6a_accessories.htm (2pgs).

Northrop Grumman Remotec ANDROS F6A Heavy Duty Robot, http://www.es.northropgrumman.com/remotec/details/f6a_specs.htm (2pgs).

Northrop Grumman Remotec ANDROS F6A Heavy Duty Robot, http://www.es.northropgrumman.com/remotec/wolverine.htm (1pg).

Northrop Grumman Electronic Systems-Remotec ANDROS Wolverine Accessories, http://www.es.northropgrumman.com/remotec/details/wolverine_accessories.htm (2pgs).

Northrop Grumman Remotec ANDROS Mark V-A1 Hazardous Duty Robot, http://www.es.northropgrumman.com/remotec/markval.htm (2pgs).

Northrop Grumman Electronic Systems-Remotec-Law Enforcement, SWAT Application, http://www.es.northropgrununan.com/remotec/law_enforcement_swat.htm (2pgs).

Battelle, Law Enforcement Robot Technology Assessment, TWSWG Task T-150B2, Apr. 2000 (87pgs).

* cited by examiner

SAFE AND ARM SYSTEM FOR A ROBOT

RELATED APPLICATIONS

This application claims the benefit of and priority to U.S. Provisional Patent Application Ser. No. 60/736,612 filed Nov. 14, 2005 entitled ROBOT TECHNOLOGY.

FIELD OF THE INVENTION

This subject invention relates to safe and arm systems for munitions.

BACKGROUND OF THE INVENTION

Safe and arm systems for munitions including weapons, explosives, and the like are well known and typically require the activation of more than one switch and/or the use of special keys or codes in order to fire the weapon, detonate a blasting cap, launch a missile, or the like. Many such systems are complex and expensive.

The applicant's successful Talon™ robot is used by the military, for example, to remotely inspect possible dangerous scenarios including road side bombs. The Talon™ robot can be equipped with munitions such as a weapon, a blasting cap, and other explosive devices. It is important that the fire control subsystem for such a robot ensures the munition is not activated or fired unintentionally. Unintentional firing could occur when the fire control subsystem is first connected to the munition in the proximity of the user with or without power supplied to the robot, when the robot is powered and then driven to a desired location, and/or upon the robot's return to its user.

No known system provides safe multi-device firing capability in a way that prevents inadvertent firing sequences in a simple and secure manner. Complex and expensive safe and arm systems cannot be used in connection with a robot such as the Talon™ robot and any safe and arm system for such a robot must be compact, simple in design, and inexpensive.

SUMMARY OF THE INVENTION

It is therefore an object of this invention to provide a safe and arm system which provides safe multi-device firing capability.

It is a further object of this invention to provide such a safe and arm system which prevents inadvertent firing sequences.

It is a further object of this invention to provide such a safe and arm system which is simple in design and which can be implemented in a compact and inexpensive unit carried by a robot.

It is a further object of this invention to provide such a safe and arm system which, although easy to use, provides security in a reliable manner.

The subject invention results from the realization that a simple in design and yet reliable safe and arm system providing multi-firing capability without being susceptible to inadvertent firing sequences is effected by the inclusion of three circuits which monitor each other and control the munition connection terminals which are initially unpowered, without a ground, and shorted together. A power supply control circuit is configured to supply power to the firing circuit. A ground supply circuit is configured to ground one terminal. A terminal shorting circuit is configured to remove the short across the pair of terminals. In this way, the munition is initiated only after first and second arm switches and a fire switch are activated in the proper sequence.

The subject invention, however, in other embodiments, need not achieve all these objectives and the claims hereof should not be limited to structures or methods capable of achieving these objectives.

This subject invention features a safe and arm system comprising an operator subsystem including a first arm switch, a second arm switch, and a fire switch. A fire control subsystem is responsive to the control subsystem and includes at least a pair of terminals for connection to a munition. The terminals are initially shorted together and without a ground. A power supply control circuit is configured to supply power to the terminals. A ground supply circuit is configured to ground one terminal. A terminal shorting circuit is configured to remove the short across the pair of terminals. The power the supply control circuit, the ground supply circuit, and the terminal shorting circuit are configured to ground one terminal, remove the short across the pair of terminals, and to supply power to the terminals but only if the first and second arm switches and the fire switch are all activated in a predetermined sequence.

A typical operator subsystem includes a microcontroller programmed to monitor activation of the first arm switch, the second arm switch, and the fire switch and to monitor feed back from the power supply control circuit, the ground supply circuit, and the terminal shorting circuit to confirm the predetermined sequence has been followed. The microcontroller may be programmed to provide an error message if the second arm switch is activated before the first arm switch or the fire switch is activated before the second arm switch.

A typical fire control subsystem includes two isolated power supply inputs, a first power supply input for supplying power to the circuitry of the fire control subsystem and a second power supply input for supplying power to the terminals. The first power supply input may be connected to the fire control subsystem only when the first arm switch is activated. The power supply control circuit may include a first relay between the first power supply input and three independent processors. The ground supply circuit and the terminal shorting circuits include a relay controlled by one or more of the three independent processors. The typical operator subsystem includes indicators confirming the fire control subsystem has received and acted on predetermined commands via the first arm switch, the second arm switch, and the fire switch.

The subject invention also features a method of safely and securely initiating munition connected to a pair of terminals. The preferred method comprises initially shorting the terminals together, initially removing any ground from the terminals, initially providing no power to the terminals. The munition is connected the terminals. The short across the terminals is removed, a ground is supplied to one terminal, and power is supplied to the terminals to initiate the munition but only if three activations occur in a predetermined sequence. An operator control unit is typically supplied with a first arm switch, a second arm switch, and a fire switch and the three activations include activating the first arm switch, the second arm switch, and the fire switch in order.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
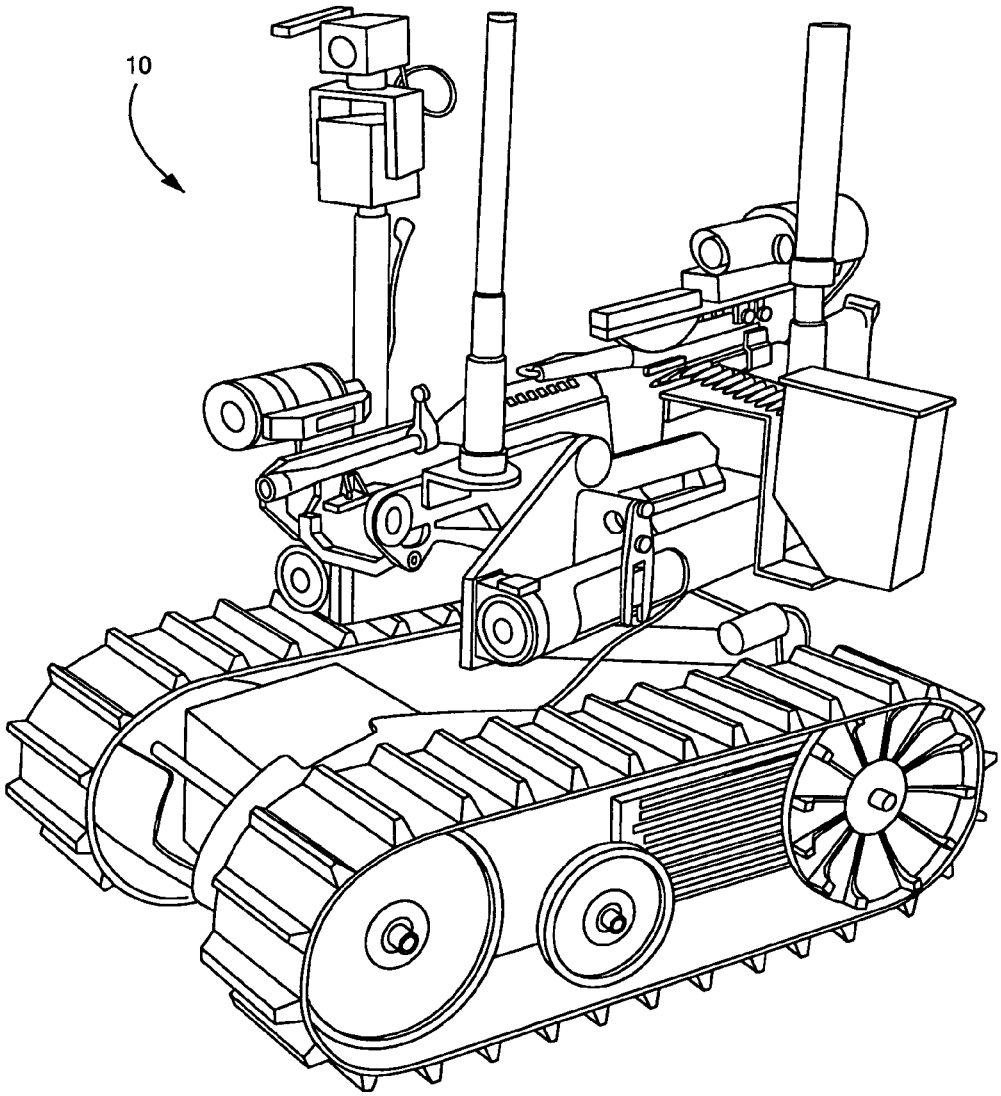
FIG. 1 is a schematic three-dimensional view showing an example of a robot equipped with a weapon activated by the safe and arm system of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
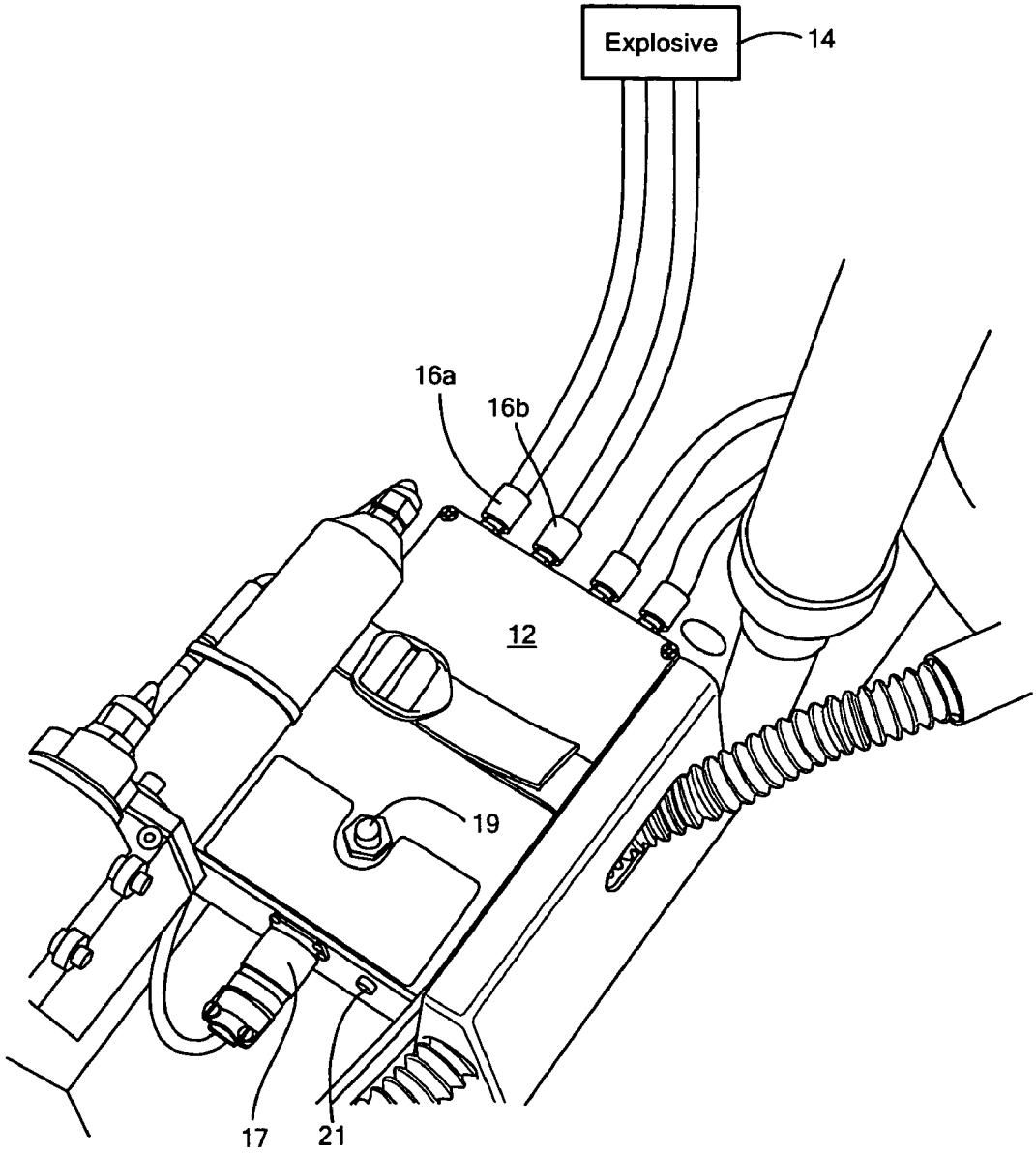
FIG. 2 is a three-dimensional schematic view of an embodiment of a fire control unit in accordance with the subject invention connected to an explosive carried by the robot shown in FIG. 1.

FIG. 1 shows a robot 10 with a weapon (e.g., a machine gun or rifle). A munition, or an explosive could also be carried by robot 10. FIG. 2 shows fire control unit 12 mounted on the robot. Fire control unit 12 typically has two or more channels. Explosive 14 is shown connected to the terminals 16*a* and 16*b* of one channel. Connection 17 connects fire control unit 12 to the power supply and radio interface subsystems of robot 10, FIG. 1. Test button 19 tests to see if there is power present from the robot and also to make sure the LED 21 is working properly. If the red LED 21 is on, then it is safe to assume that the fire control unit 12 is not in a "safe" state. If the LED 21 is off then it is in a "safe" state. The button also provides a means to verify that the LED 21 is functioning properly. So, when the button 19 is pushed, battery power from the robot is applied to the LED 21 causing it to illuminate.

Figure 3:
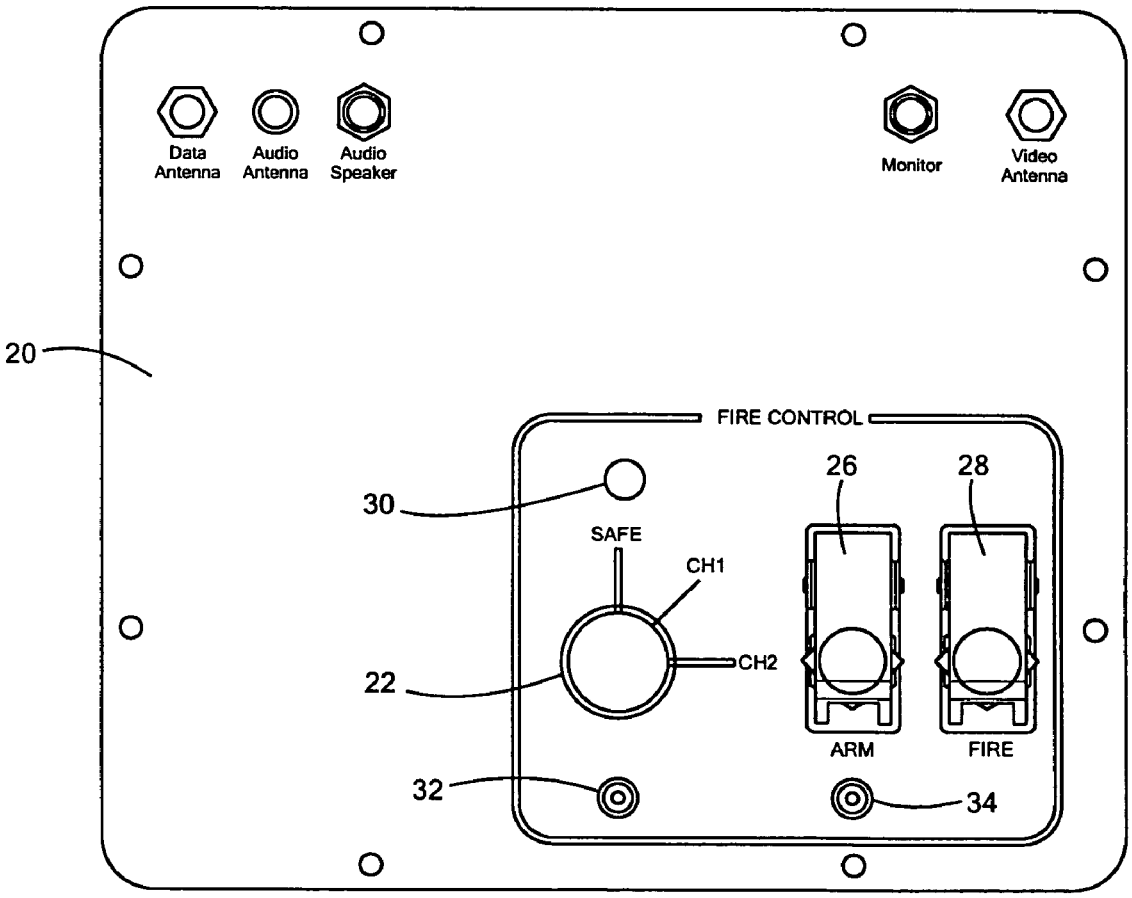
FIG. 3 is a schematic three-dimensional view showing an example of an operator subsystem (user) unit in accordance with the subject invention.

FIG. 3 depicts operator control unit (OCU) 20 which interfaces (wirelessly or via a cable connection) with fire control unit 12, FIG. 2. Operator control unit 20 includes first arm switch 22, typically a key activated switch with three positions: safe, channel 1, and channel 2. Operator unit 20 also includes second arm switch 26 with a cover and fire switch 28 also with a cover. Also provided is fire control unit status indicator 30, channel select indicator 32, and armed indicator 34. All three indicators are typically LEDs.

Figure 4:
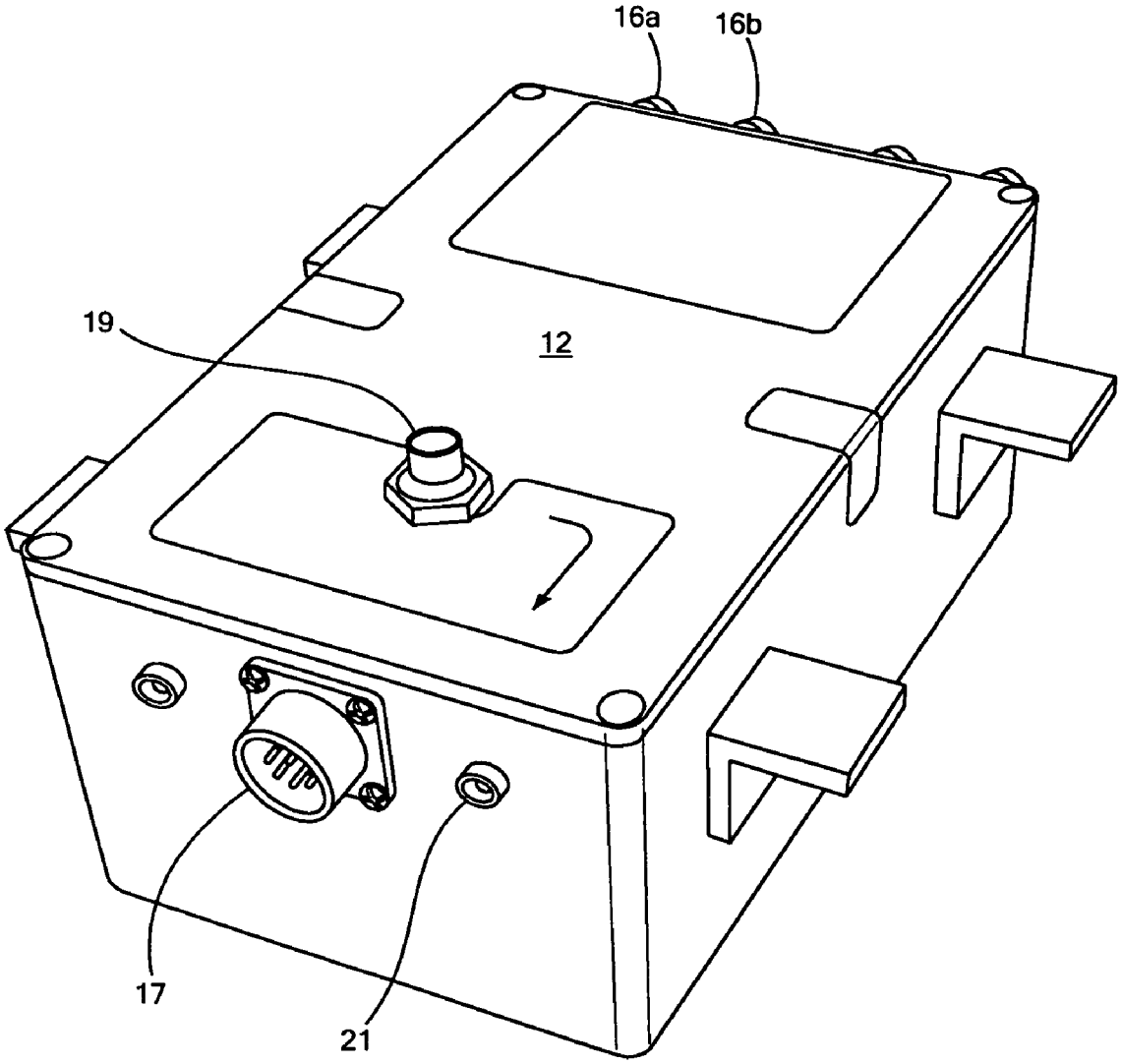
FIG. 4 is a schematic three-dimensional view of the fire control subsystem unit shown in FIG. 2.

According to the present invention, terminals 16*a* and 16*b*, FIG. 4 of fire control unit 12 are shorted together, are not powered, and are not grounded to reliably prevent triggering a munition or weapon connected to them until the operator so intends. Only when a) the key arm switch 22, FIG. 3 is turned from the safe position to the channel 1 position, b) followed by a correct response from the fire control unit 12, FIG. 4 that illuminates LED 32, on control panel 20, c) followed by selecting the arm switch 26, d) followed by a correct response from the fire set box 12 that illuminates LED 34 on operator control unit 20, e) followed by selecting fire switch 28, will the power be applied to terminal 16A, the short removed from across terminals 16A and 16B, and a ground connection applied to terminal 16B and terminals 16A and 16B be energized. Short removal and ground supply occur simultaneously and the terminals are energized one second thereafter when the proper sequence has been followed and when fire switch 28 has been activated. All of these actions must be carried out in sequence and the responses from the fire control unit 12 must happen in a predetermined amount of time (seconds, for example) in order for terminals 16A and 16B to be energized.

In this way, the safe and arm system of the subject invention prevents inadvertent firing sequences. This result is effected by the inclusion of three circuits which monitor each other and control the munition connection terminals which are initially unpowered, without a ground, and shorted together. Although the power supply control circuit, the ground supply circuit, and the shorting circuit are all independently controlled and takes three separate steps to enable them to be energized, the operation of all three occur quickly. Also, each control circuit monitors all commands that are received from the OCU 20, FIG. 3. The power supply control circuit will be energized, the ground supply circuit will be energized, and the shorting circuit will be removed only after the channel select switch 22 has been activated, the arm switch 26 is activated and the fire switch 28 has been activated.

Control unit 20, FIG. 3 has three LEDS indicating that a channel has been selected, the fire control unit 12, FIG. 4 is armed and a redundant indication of the state of the fire control unit 12. The operation of each LED is based on a closed loop design. The lights are turned on and off based on the direct feedback from fire control unit 12, FIG. 4 and fire control panel 20, FIG. 3.

Once the channel select key switch 22 is turned to select channel 1 or 2, the control unit 20 sends the appropriate command to fire control unit 12, FIG. 4. Once the message has been received and acted upon, the fire control unit 12 will respond with the appropriate message indicating which channel has been selected. Once this message is received, LED 32 is turned on solid. LED 34 is a redundant indication of the state of the vehicle fire set 12. The states for the vehicle fire set are "Safe", "Error and Safe", "Armed", "Firing" and "Fired and Safe". The on/off status indication is as follows: Safe—ON, Error and Safe—ON, Armed—OFF, Firing—OFF, Fired and Safe—ON.

The fire set sequence of operation is preferably implemented as a state machine. Once the fire control unit 12, FIG. 4 is connected to the vehicle and the system is powered up, the typical sequence of operation is as follows.

First, the switches are reset to the safe position. If the switches are not reset prior to operation, the fire control unit 12 will not arm or fire, LEDS 32 and 34, FIG. 3 will flash and controller 50, FIG. 5 will log an error. Channel Select switch 22, FIG. 3 is set to the "safe" switch position. Arm switch 26 is toggled to the "off" position. Closing the switch cover mechanically forces the switch into the "off" position. Fire switch 28 is toggled to the "off" position. Again, closing the switch cover will mechanically force switch 28 into the "off" position.

Next, Channel Select switch 22 is actuated to select the channel to be fired. Once the channel switch is turned to select either channel 1 or 2, the unit 20 will read the status and command the robot to provide power to the fire control unit 12, FIG. 4. Once confirmation is received indicating that the appropriate channel has been selected, the "channel selected" LED 32, FIG. 3 is turned on alerting the operator. Once the "channel selected" LED 32 is turned on, the operator may proceed to the next step. If the operator tries to toggle arm 26 or fire switch 28 before the LED 32 is illuminated, an error will occur. This error will cause both the "channel select" 32 and "arm" 34 LEDS to flash in an alternating pattern at a rate of 1 sec. Once the system has entered this condition, the user must start from the first step.

Once the robot has acknowledged the channel select command and the channel select 32 LED has turned on steady, the operator can now "arm" the fire set. The operator must lift the mechanical switch guard exposing arm switch 26. To arm this switch, it is pushed forward into the "arm" position. Control unit 20 then sends the appropriate command to fire control unit 12, FIG. 4. Upon receipt and execution of this command, the fire control unit 12 responds with the appropriate command at which point "arm" LED 34, FIG. 3 is turned on steady. If the operator toggles "fire" switch 28 before the "arm" LED 34 comes on steady it will cause both the "channel select" 32 and "arm" 34 LEDS to flash in an alternating pattern at a rate of 1 sec. Once the system has entered this condition, the user must start from the first step.

Once the "channel select" 32 and "arm" 34 LEDS are turned on steady, "fire" switch 28 can now be used. The operator must lift up the mechanical switch guard to expose fire toggle switch 28. To execute a fire command, the operator must push and hold fire switch 28 in the fire position for a minimum of 1 second. If the switch is released prior to the one second timeout, fire control unit 12 will remain in the "armed" state and the fire switch actuation will be ignored. Once the "fire" command has been issued, fire control unit 12 set will return a "fired and safe" status message. Once this message is received by operator control unit 20, the "channel select" 32 and "arm" 34 LEDS will turn off and stay off until the system is reset as described above.

Safing the system can be accomplished in a one step action. Safing the system can be accomplished by setting channel select switch 22 into the safe position or by putting arm switch 26 into the safe position. Performing any operation out of sequence will cause fire control unit 12 to error out and will return it to the safe condition. The safe condition is described as removing the voltage and ground connections from posts 16*a* and 16*b* and engaging a shunt across the same posts.

Figure 5:
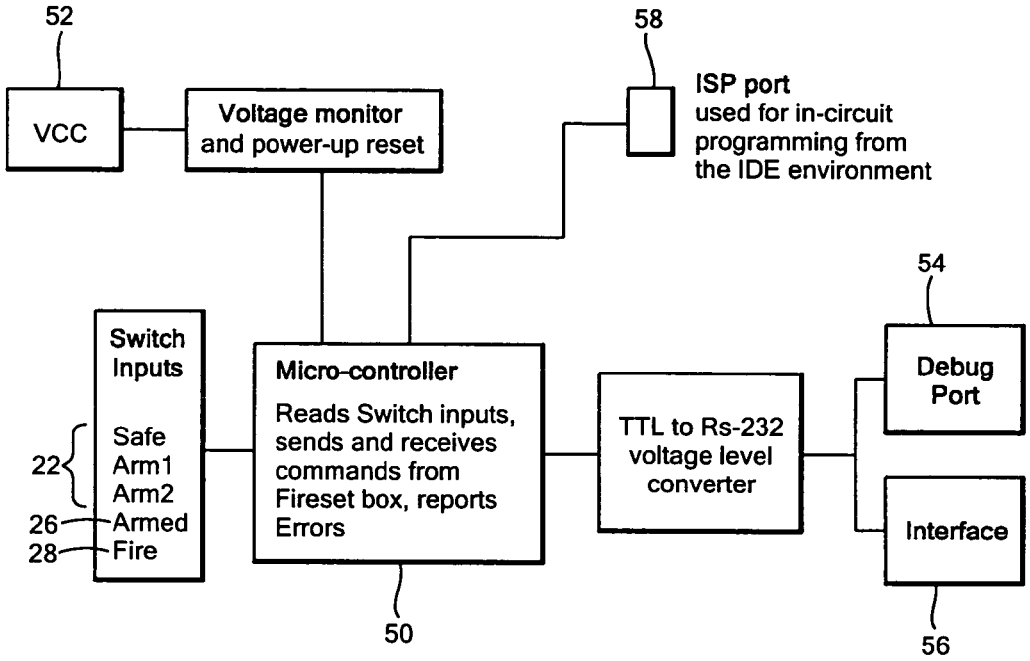
FIG. 5 is a block diagram showing the primary components associated with the circuitry of the operator subsystem shown in FIG. 3.

Controller 50, FIG. 5 of the operator unit 20, FIG. 3 reads the switch inputs, controls communication between the operator control unit 20 and the fire control unit 12, reports and logs errors, and displays fire control status via the LEDS 32, 34, and 30 mounted in the operator unit panel 20. Voltage monitor 52 keeps micro-controller 50 in the reset state until the input voltage reaches a predefined level to insure proper boot up of the micro-controller. Debug Port 54 is used to download code via the robot GUI. RS-232 56 port sends and receives serial commands to the fire control unit 12 via the robot's command and control link. ISP Port 58 is used by the PIC controller IDE (Integrated Design Environment) to program and debug the PIC processor that is used in the design of the fire control unit 12 and operator control unit 20.

On power up, micro-controller 50 determines what "state" the switches are in. Upon power up, every switch must be in a "safe" state, meaning the key selector switch 22 is in the "safe" state, the arm switch 26 is not selected and the fire switch 28 is not selected. If any switch is not in the "safe" power up state, then controller 50 will error out and start flashing the indicating LEDS 32 and 34. If controller 50 passes the initial power up test, it will then allow the proper sequence to be initiated. Now, if the key switch 22 is changed from the "safe" to the Channel 1 select, controller 50 will read all of the switch inputs and determine what "state" the controller 50 is, meaning it will determine if it is in the "safe" state. If all the switches are in the safe state prior to selecting Channel one, then controller 50 will sense the change and send a command to fire control unit 12, FIG. 4 via interface 56, FIG. 5 to apply power to fire control unit 12 allowing onboard processors 70, 72, and 74, FIG. 6, of fire control unit 12, to boot up. At the same time operator control unit 20 will sense the change and send a command to the fire control unit 12, FIG. 4 via interface 56, FIG. 5 to select Channel one. Controller 50, FIG. 5 will then wait until it receives a command back from fire control unit 12, FIG. 6 indicating that it has powered up correctly and is in the Channel one arm mode. The OCU controller detects a change in key switch 22 state and sends a command to the robot controller which in turn sends a command to the VMUX to supply power to the fire control unit. At the same time the OCU fire control panel.

When controller 50, FIG. 5 receives an "Arm" command, it looks to determine that it is already in the "CH1" or "CH2" state previous to the "Arm" selection 26 and that the "Fire" switch 28 is not selected. If either one of these conditions are not true then the controller will error out and flash LEDS 32 and 34, log the error and send it out via the debug serial port. If the "CH1" or "CH2" are selected and the "Fire" switch 28 are in the "safe" state, then controller 50 sends out an "Arm" command to fire control unit 12, FIG. 6. Unit 12 then determines if it is in the "CH1" or "CH2" armed state. If so, fire control unit 12 will then move to the "Armed" state and send a return command to controller 50 indicting that it has transitioned to correct state. Controller 50 will then turn on the "Armed" LED 34. This light will only turn on if controller 50 received the correct returned message from unit 12, FIG. 6 in a timely manner. Each message that is sent from controller 50, FIG. 5 to unit 12, FIG. 6 must be responded to within a predefined limit. If it does not then controller 50 will error out, flash LEDS 32 and 34 log the error and send it out via debug port 54.

When controller 50 receives a "Fire" command, it looks to determine that it is already in the "CH1" or "CH2" state and the "Arm" Switch 26 is already in the "Arm" state previous to the "Fire" selection. If either one of these conditions are not true then controller 50 will error out and Flash LEDS 32 and 34, log the error and send it out via debug serial port 54. If the "CH1" or "CH2" are selected and the "Arm" switch 26 is selected then controller 50 will send out a "Fire" command to unit 12, FIG. 6. Unit 12, FIG. 6 will then proceed to the next state, provided all conditions are met. If unit 12 is in the appropriate state, then it will fire. While firing, unit 12 will send a command back to controller 50, FIG. 5 indicating that it is firing. The green LED on operator control unit 20, FIG. 3 will stay not lit indicating that it is not in the safe state. Once unit 12, FIG. 6 has fired correctly, it will send a command back to controller 50, FIG. 5 indicating that it has fired and is in the safe condition.

Figure 6:
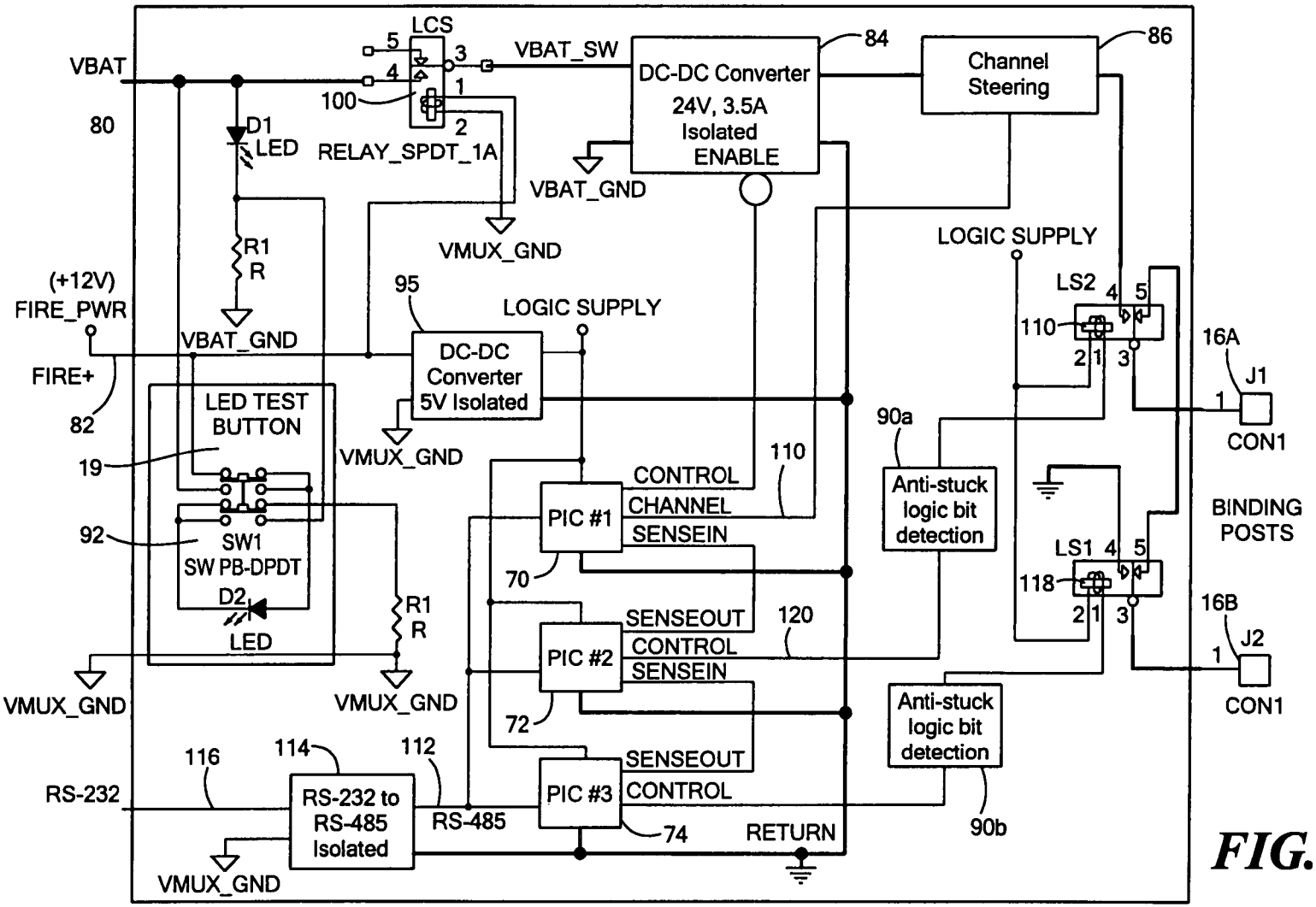
FIG. 6 is a schematic block circuit diagram showing the primary components associated with the fire control subsystem shown in FIG. 4.

The system is designed such that no single point failure can cause the system to become unsafe. The circuitry of fire control unit 12, FIG. 6 is preferably designed around three microcontrollers 70, 72, and 74 (e.g., MicroChip Technology, Inc.'s PICs) connected via an internal RS-485 bus network and individual status feedback connections from each other. All the PICs monitor and receive all commands on the RS-485 bus. Each PIC has a separate discrete function. PIC 70 controls the power supply to the unit that charges the capacitor used to fire a munition. PIC 72 controls the short or bridge across terminals 16*a* and 16*b* and provides ground to one of the binding posts PIC 74 supplies the power. By separating the responsibility of the firing sequence across three microcontrollers, the possibility that an inadvertent firing sequence can occur is greatly reduced.

The outputs of PICs 74 and 72 connect to separate relays through two circuits that protect against stuck logic 90*a* and

90*b*. For example, when PIC 74 has been commanded to apply ground to the binding post, the output of PIC 74 will have to toggle its output at a period of 25 ms. If the oscillation stops high or low, the relay will be disconnected. The toggling of the PIC is not done in an ISR (Interrupt Service Routine), it is done in the main loop. However, an ISR is used to increment the timers. This ensures that the PICs are properly executing code.

The firing sequence will start by grounding the binding post, removing the short across the post, and enabling the power supply. This occurs when the last step of the firing sequence has been initiated. The unit will remain in this state for at least 3 seconds, after which all the PICs will reset. However, PIC 72 will not enable its output, even if commanded, if it does not sense that PIC 70 agrees. This goes for PIC 74 monitoring PIC 70. This ensures that the sequence does not continue if the hardware does not agree. This agreement or confirmation is accomplished through hardware bits that are an output of one PIC to the input of the next. Each input bit is de-bounced preventing any false triggers due to internal system noise or other external influences.

Since the Vbat 80 and the Fire Power (+12V) 82 inputs are isolated, two isolated power supplies are used to generate the logic power 95 and the ignition power 84. The output returns of both power supplies are connected together. There is no onboard storage of ignition power. That is, when the ignition power is finally enabled, DC-DC converter 84 supplies 24V at 3 A to terminals 16*a* and 16*b*. The current limit circuit resides in DC-DC converter 84 and limits the current to 3 A in the event of a short.

The preferred power supply control circuit of fire control unit 12, FIG. 4 includes relay 100, FIG. 6 DC-DC Connector 84, PIC 70, channel steering circuit 86, and relay 110 and anti stuck logic 90A. The ground supply circuit includes relay 118 and PICs 72, 74, and anti stuck logic 90*b*. The terminal shorting circuit includes relay 118 and PICs 72, 74, and anti stuck logic 90*b*. When channel select switch 22, FIG. 3 is moved from the safe position to channel 1 position, a signal is applied at 82, FIG. 6 which then allows relay 100 to supply voltage VBAT to DC to DC converter 84, which then provides 24 volts DC to channel steering circuit 86. Relay 100 allows signals DC to DC converter 95 to supply a plus 5 volt signal to power on PICs 70, 72, and 74. PIC 70 supplies channel steering circuit 86 with a signal via channel line 110 to indicate the channel chosen. PIC 70 also responds back to OCU 20, FIG. 3 via line 112, FIG. 6 RS-232 to RS-485 converter 114 and via RS-232 channel 116 to indicate to OCU 20, FIG. 3 that the appropriate channel has been selected.

Upon receiving an arm channel command via the RS-232 input 116, FIG. 6, all three PICs 70, 72, and 74 receive the arm channel command and change their state. PIC 74 also sets its sense pin high so PIC 72 knows what state it is in. All three PICs see the command and change their state to look for an Arm command. PIC 72 also sets its sense pin high so PIC 70 knows what state it is in. Upon receiving an Arm command on RS-232 input 116, all three PICs 70, 72, and 74 see the command and change their state to arm. PIC 70 also sets its sense pin high so PIC 74 knows what state it is in. When the fire state PICs 72-74 asserts their relays, PIC 72 applies a ground via relay 118 to terminals 16*a* and 16*b* and removes the short previously present across them. PIC 72 via control line 120 applies a 24-volts DC signal via relay 110 to terminal 16A. When in the fire state, PIC 70 powers on the 24V DC-DC converter 84 which charge the 3000 micro Farad capacitor. After one second with DC-DC converter powered and the 3000 micro Farad capacitor charged, PIC 70 routes the 24VDC to the post of the channel that was selected. 24VDC and ground are supplied to the posts for three seconds and the PICs will reset into safe states thereafter.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A safe and arm system comprising:

an operator control subsystem including:

a first arm switch including a safe state and at least one armed state, a second arm switch including a safe state and an armed state, and a fire switch including a safe state and a firing state; and a fire control subsystem responsive to the operator control subsystem and including:

at least a pair of terminals for connection to a munition, the terminals initially shorted together and without a ground, a power supply control circuit including a first microcontroller configured to supply power to the terminals, a ground supply circuit including a second microcontroller configured to ground one said terminal, and a terminal shorting circuit including a third microcontroller configured to remove the short across the pair of terminals, the power supply control circuit, ground supply circuit, and terminal shorting circuit configured to ground one terminal, remove the short across the pair of terminals, and to supply power to the terminals only if the first and second arm switches and the fire switch are all activated from the corresponding safe state in a predetermined sequence, each microcontroller configured to monitor at least one other microcontroller to ensure the microcontrollers agree said predetermined sequence has occurred within a predetermined time before said one terminal is grounded, the short across the pair of terminals is removed, and power is supplied to the terminals.

2. The system of claim 1 in which the operator control subsystem includes a microcontroller programmed to monitor activation of the first arm switch, the second arm switch, and the fire switch and to monitor feed back from the power supply control circuit, the ground supply circuit, and the terminal shorting circuit to confirm the predetermined sequence has been followed.

3. The system of claim 2 in which the microcontroller is programmed to provide an error message if the second arm switch is activated before the first arm switch or the fire switch is activated before the second arm switch.

4. The system of claim 2 in which the microcontroller is programmed to provide a power up test to determine a state of the switches.

5. The system of claim 1 in which the fire control subsystem includes two isolated power supply inputs, a first power supply input for supplying power to the circuitry of the fire control subsystem and a second power supply input for supplying power to the terminals.

6. The system of claim 5 in which the first power supply input is connected to the fire control subsystem only when the first arm switch is activated.

7. The system of claim 6 in which the power supply control circuit includes a first relay between the first power supply input and the three independent processors.

8. The system of claim 7 in which the ground supply circuit and the terminal shorting circuits include a relay controlled by one or more of the three independent processors.

9. The system of claim 1 in which the operator control subsystem includes indicators confirming the fire control subsystem has received and acted on predetermined commands via the first arm switch, the second arm switch, and the fire switch.

10. The system of claim 1 in which the fire control subsystem further includes a test mechanism for testing the fire control subsystem.

11. The system of claim 1 in which the first arm switch includes two or more channels each having an armed state.

12. The system of claim 11 in which the fire control subsystem further includes a channel steering circuit for determining which of two or more channels has been selected.

13. A method of safely and securely initiating munition connected to a pair of terminals, the method comprising:

initially shorting the terminals together;

initially removing any ground from the terminals;

initially providing no power to the terminals;

connecting the munition to a pair of terminals;

using a third microcontroller to remove the short across the terminals, using a second microcontroller to supply a ground to one terminal, and using a first microcontroller to provide power to the terminals to initiate the munition only if three activations occur in a predetermined sequence; and for each microcontroller, monitoring at least one other microcontroller to ensure the microcontrollers agree said predetermined sequence has occurred within a predetermined time before said one terminal is grounded, the short across the pair of terminals is removed, and power is supplied to the terminals.

14. The method of claim 13 further including supplying an operator control unit with a first arm switch, a second arm switch, and a fire switch, the three activations including activating the first arm switch, the second arm switch, and the fire switch in order.

* * * * *